US006027187A

United States Patent [19]

Siepmann

[11] Patent Number: 6,027,187

[45] Date of Patent: Feb. 22, 2000

[54] HUMIDIFIER FOR USE IN HUMIDORS

[75] Inventor: James Patrick Siepmann, Oshkosh, Wis.

[73] Assignee: Victoria Lynn Siepmann, Oshkosh, Wis.

[21] Appl. No.: 08/903,212

[22] Filed: Jul. 22, 1997

[51] Int. Cl.[7] ..... A24F 25/00

[52] U.S. Cl. ..... 312/31; 239/53; 239/58; 239/59; 206/213.1; 206/242

[58] Field of Search ..... 312/31.01, 31.3, 312/31.1, 31.2, 31, 114; 239/34, 53, 55, 58, 59, 51.5; 206/204, 205, 213.1, 242; 131/300; 261/99, 104, DIG. 14

[56] References Cited

U.S. PATENT DOCUMENTS

| | | | |
|---|---|---|---|
| 219,819 | 9/1879 | Knowlton . | |
| 366,435 | 7/1887 | Swift | 312/31 X |
| 378,641 | 2/1888 | Arnold | 312/31 |
| 518,286 | 4/1894 | Streator . | |
| 980,127 | 12/1910 | Raabe | 312/31 |
| 1,054,159 | 2/1913 | Wilson . | |
| 1,059,693 | 4/1913 | Woods . | |
| 1,318,939 | 10/1919 | Willert | 312/31.2 |
| 1,376,506 | 5/1921 | Beskin | 312/114 |
| 1,609,766 | 12/1926 | Osaka | 312/31.3 |
| 1,843,514 | 2/1932 | Levy | 312/31.3 |
| 2,639,958 | 5/1953 | Stephenson | 312/114 X |
| 2,774,187 | 12/1956 | Smithers . | |
| 2,914,876 | 12/1959 | Osler . | |
| 2,977,171 | 3/1961 | Gleason . | |
| 3,023,064 | 2/1962 | Sosa . | |
| 3,030,161 | 4/1962 | Bushong | 239/51.5 X |
| 3,049,444 | 8/1962 | Palombo . | |
| 3,135,565 | 6/1964 | Bingham | 206/242 X |
| 3,254,841 | 6/1966 | De Loncker, Sr. . | |
| 3,305,287 | 2/1967 | Rait . | |
| 3,431,038 | 3/1969 | Berliner . | |
| 3,474,598 | 10/1969 | Keuls | 261/99 X |
| 4,428,892 | 1/1984 | Berliner | 312/31.01 X |
| 5,317,832 | 6/1994 | Kollen . | |

*Primary Examiner*—Peter M. Cuomo
*Assistant Examiner*—Janet M. Wilkens
*Attorney, Agent, or Firm*—Michael L. Winkelman; Thomas D. Wilhelm

[57] ABSTRACT

A humidifier for use in humidors includes a fill chamber, an emission chamber having at least one absorbent body therein, at least one opening in the top of the emission chamber for diffusing water vapor therethrough, and an adjustment apparatus for adjusting and controlling the amount of water vapor entering the humidor through the opening. Absorbent bodies are preferably separated by at least one channel. The channel extends along the lengths of the absorbent bodies to increase the rate at which the absorbent bodies absorb water. The channel separates the absorbent bodies into separate elements. The humidifier comprises a housing defining a receptacle having an internal void volume for receiving material. The volume of the absorbent bodies, in combination, preferably comprises from about 35% to about 70%, and most preferably from about 40% to about 50% of the internal void volume of the receptacle. The emission chamber preferably comprises about 40% to about 90%, and most preferably about 60% to about 75% of the internal void volume of the receptacle.

45 Claims, 5 Drawing Sheets

HUMIDIFIER FOR USE IN HUMIDORS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND

This invention relates to a humidifier device for use in a humidor with the ability to allow controlled evaporation of hydrophyllic liquids such as water. The most initial utilization of this device would be for cigar humidors which are used to store cigars and other tobacco products. Various methods of supplying humidity to the humidor include built-in tanks and sponges. Some built-in tanks have water under the cigars. As the water evaporates water vapor reaches the cigars through apertures below the cigars. In these humidors the humidity tends to be nonuniformly distributed because humid air is heavier than dry air and tends to remain at lower locations in the humidor. Further, having apertures under the cigars permits cigar dust to settle through the apertures below and into the water tank via gravity. Therefore, built-in water tanks require more frequent cleaning.

Other humidors include a portable humidifier placed in the humidor. Such portable humidifiers generally are limited in their ability to disperse humidity evenly throughout the humidor or their ability to control the amount of humidity being output therefrom.

Therefore, an object of the invention is to provide a portable, light weight, humidifier having the ability to last a long time between refills due to a reservoir yet having a mechanism by which controlled evaporation can occur at the top of the humidor, such that the humidity diffuses downwardly through the humidor and is thus more evenly dispersed within the humidor. Further, the humidifier of the invention permits manual regulation of the amount of humidity inside of the humidor. Thus cigars can maintain proper quality and freshness for longer periods of time.

Another object of the invention is to provide a humidifier having the proper size and shape to fit into a humidor and dispense humidified air at the top portion of the humidor. The size of the opening in the humidifier can be adjusted to vary the amount of humidity diffused from the humidifier such that the humidor maintains relative humidity at about 70%. The humidifier includes an absorbent body disposed below at least one opening in the humidifier. The absorbent body preferably is at least as long as the opening. The absorbent body comprises spaced sections of material having a top surface area that is less than or equal to the surface area at the bottom of the spaced sections. This arrangement permits water to move upwardly to the top surface of the spaced sections of foam material.

SUMMARY

Some of the objects are obtained in a first family of embodiments comprehending a humidor for storing tobacco products in a suitable humidity environment, the humidor having a top and a bottom, and a lid associated with the top, and including a humidifier comprising a fill chamber for receiving water, an emission chamber for receiving water from the fill chamber, the emission chamber having a top and including at least one absorbent body therein, water evaporating from the absorbent body and water vapor so formed diffusing out of at least one opening in the top of the emission chamber, the opening being located near the lid of the humidor, such that the water vapor moves downwardly therefrom toward the bottom of the humidor, and adjustment apparatus adjusting the amount of water vapor entering the humidor through the opening.

In most embodiments the opening extends along the length of the top of the emission chamber.

In some embodiments, the adjustment apparatus comprises slats mounted in track elements at first and second ends at the top of the emission chamber, the slats extending along the length of the top of the emission chamber, and being moveable transversely across the top of the emission chamber to at least partially close the at least one opening and thereby to modify the amount of water vapor emitted from the emission chamber.

In most embodiments, the humidor comprises a generally rectangularly-shaped receptacle having an inside height, inside length, and inside width, and the humidifier has a length, a width, and a height, the length of the humidifier extending substantially across the entirety of no more than one of the inside width and the inside length of the receptacle. The height of the humidifier is less than the inside height of the receptacle, such that water vapor can readily diffuse from the top of the humidifier and into and through a space between the top of the humidifier and the lid, thus to move thence throughout the humidor.

In most embodiments, the humidifier comprises less than 20% of the total contained volume inside the humidor when the lid is closed, the volume being defined by inside height, inside length, and inside width.

In preferred embodiments, the humidifier has a rectangular-shape. The humidifier generally is removable from the humidor for servicing thereof.

In most embodiments, the fill chamber and the emission chamber have sufficient volume that the humidifier provides desired amounts of water vapor to the humidor for about 3 to about 6 months without requiring the addition of water.

In most embodiments, channels extend between the absorbent bodies along the respective entire lengths and heights thereof, so to define the separate absorbent bodies. These channels allow for rapid absorbing of water such that a greater amount of water can be utilized. Each separate absorbent body has a length, a width, and a height, the heights of the absorbent bodies approximating the height of the emission chamber.

In most embodiments the collective top surface area at the combination of the respective tops of the respective absorbent bodies is no greater than the collective bottom surface area at the combination of the respective bottoms of the respective absorbent bodies. The absorbent bodies receive water and transport water therein by wicking, generally driven by surface tension phenomena, including wicking water to the top surfaces thereof.

In preferred embodiments the absorbent bodies generally have substantially rectangular shapes. The absorbent bodies generally comprise phenol-based or urea-based foam materials.

In some embodiments the at least one opening comprises one of multiple openings extending along substantially the entirety of the length of the top of the emission chamber, the multiple openings being disposed between bars which extend along the length of the top of the emission chamber.

The bars can be aligned substantially directly over the respective channels thus to impede diffusion of water vapor from above the channels and out of the emission chamber.

In some embodiments the fill chamber and the emission chamber of the humidifier comprise plastic receptacle walls, the receptacle walls of the fill chamber and bottom and side ones of the receptacle walls of the emission chamber comprising an integral plastic unit.

The housing of the humidifier may include a dividing wall partially separating the fill chamber and the emission chamber, the dividing wall assisting in retaining the at least one absorbent body in the emission chamber.

Some of the objects are obtained in a second family of embodiments comprehending a humidor including a humidifier comprising a fill chamber receiving water into the humidifier, and an emission chamber containing at least first and second absorbent bodies separated by at least one channel, the at least one channel being defined between and extending along respective lengths of the absorbent bodies along a length of the emission chamber, the at least one channel extending alongside surface areas of the absorbent bodies thereby to affect the rate at which water is absorbed into the absorbent bodies, water evaporating from the absorbent bodies and water vapor so formed diffusing out of the humidifier through at least one opening and thence outwardly from the humidifier to thereby provide moisture-laden air to the interior of the humidifier. The absorbent bodies absorb water generally until saturated, such that water is present at the top surfaces of the absorbent bodies.

In preferred embodiments, each absorbent body has a top surface area no greater than the bottom surface area at the respective bottom of the respective absorbent body.

In most embodiments, the humidifier is free from absorbent material outside the combination of the emission chamber and the fill chamber.

In some embodiments, the housing of the humidifier includes a separate top element disposed at the top of the housing to close the housing, the separate top element including at least one opening for emitting water vapor from the emission chamber, and a fill opening proximate the top of the fill chamber. The top element can include track elements located at first and second ends of the emission chamber, the track elements receiving slats extending along the length of the top of the emission chamber, the slats being moveable transversely across the width of the top of the separate top element thereby to at least partially close the at least one opening and thereby to adjust the amount of water vapor diffusing out of the emission chamber.

In some embodiments the separate top element includes spaced positioning legs extending downwardly toward the bottom of the housing inside the humidifier so as to keep the absorbent bodies separated and to provide channels for the water.

In a third family of embodiments, the humidifier for use in a humidor comprises a housing defining a receptacle, the receptacle defining an internal void volume receiving material thereinto, the receptacle further comprising an emission chamber defined within the internal void volume and having absorbent bodies therein, the volume of the absorbent bodies in combination preferably comprising from about 35% to about 70% of the internal void volume of the receptacle, the emission chamber emitting water vapor from at least one opening. In other embodiments the volume of the absorbent bodies preferably comprises from about 35% to about 70%, more preferably about 40% to about 60%, and most preferably about 40% to about 50% of the internal void volume of the receptacle.

In a fourth family of embodiments, the humidifier comprises a housing defining a receptacle, the receptacle further includes an internal void volume, and an emission chamber defined within the internal volume and having absorbent bodies therein, the emission chamber defining from about 40% to about 90% of the internal volume of the receptacle, the emission chamber emitting water vapor from at least one opening. In other embodiments, the emission chamber preferably defines about 50% to about 80%, and most preferably about 60% to about 75% of the internal volume of the receptacle.

Figure 1:
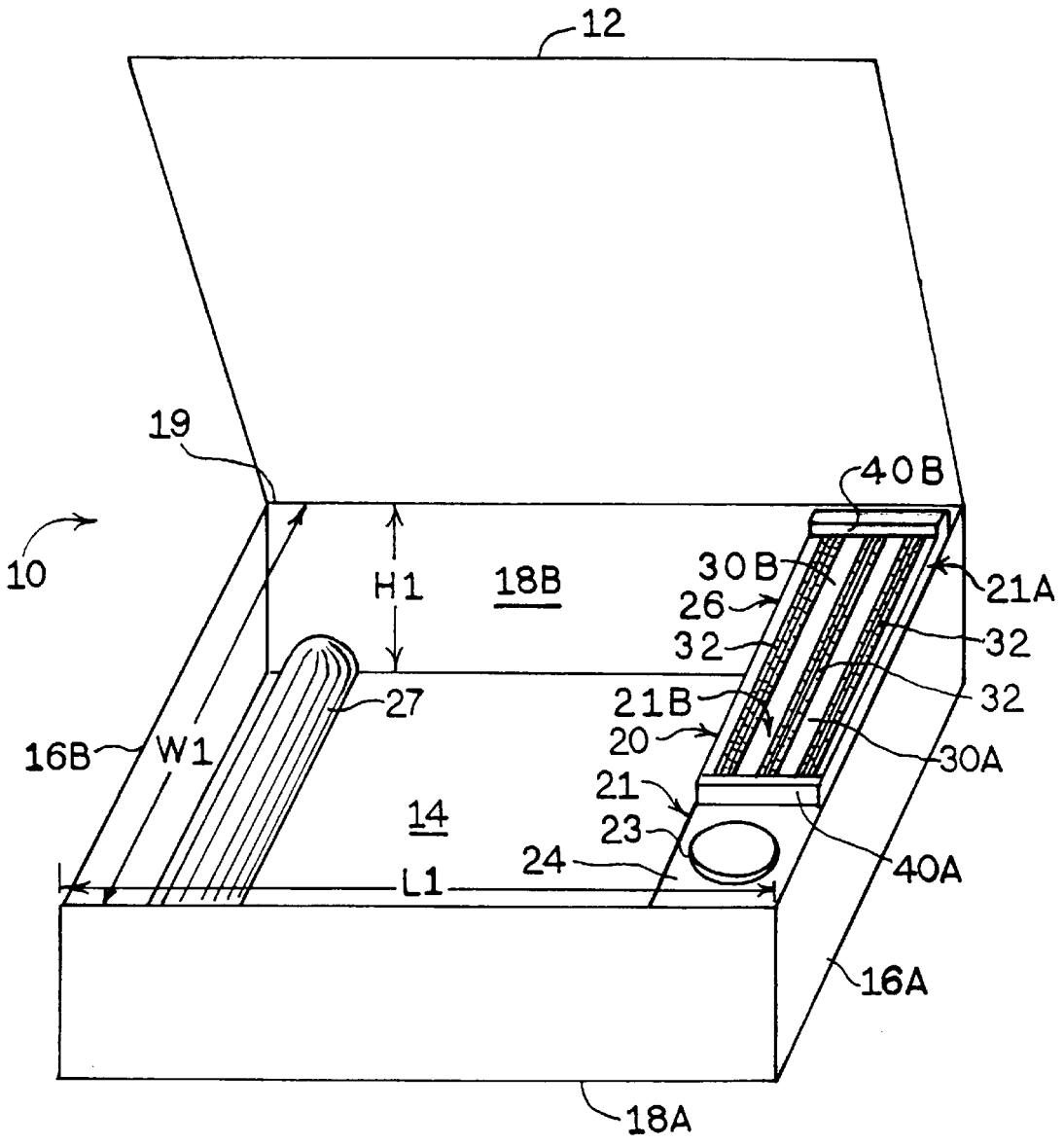
FIG. 1 shows a perspective view of a humidor containing a humidifier of the invention, the humidifier, excluding adjustment apparatus.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring now by characters of reference to the drawings, and first to FIG. 1, a humidor 10 includes a top wall 12, a bottom wall 14, side walls 16A, 16B, and front and back walls 18A, 18B. Top wall 12 comprises a lid hinged at joint 19 for opening the humidor. A humidifier 20 is shown in humidor 10, supported by bottom wall 14 and adjacent side wall 16A. Humidifier 20 maintains the relative humidity of the humidor at a proper value for tobacco products, such as cigars (one cigar 27 shown), when the humidor is closed thus to define a closed interior void volume within the humidor, the humidifier being contained within the void volume. Thus the tobacco products are maintained in a suitable humidity environment. Humidifier 20 includes a housing 21 comprising receptacle 21A and a stepped cover 21B. Cover 21B includes a fill opening 22, and a closure cap 23 in the fill opening.

Figure 2:
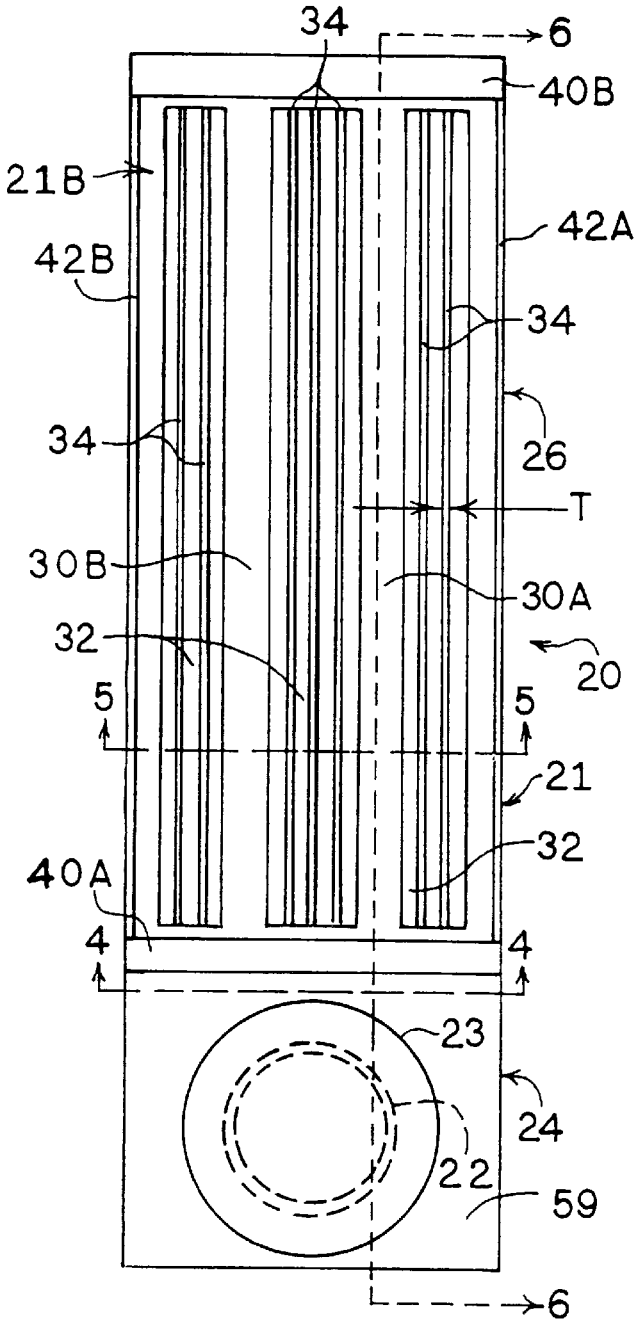
FIG. 2 shows a top view of the humidifier, excluding adjustment apparatus.

As better shown in FIG. 2, receptacle 21A and cover 21B, in combination, define an interior void volume of humidifier 20 which volume includes a fill chamber 24 and an emission chamber 26. Cover 21B includes integral support bars 30A, 30B extending along the length of emission chamber 26. Openings 32 between support bars 30A, 30B permit water vapor to exit the top of emission chamber 26, thus to increase the humidity inside the closed humidor. Anti-splash bars 34 are also integral with cover 21B, and extend within and along the entire lengths of openings 32, thereby dividing the openings and assisting in retaining water inside emission chamber 26 when humidifier 20 is tipped or moved.

Figure 3:
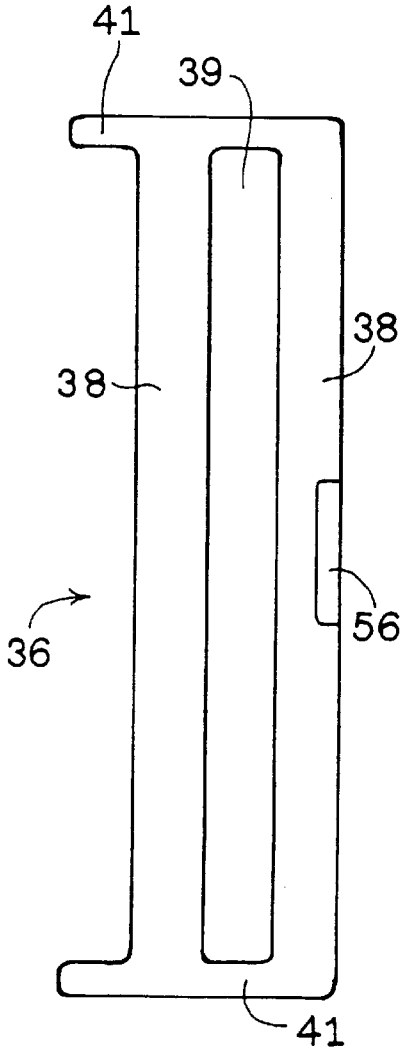
FIG. 3 shows a top view of adjustment apparatus.

FIG. 3 shows adjustment apparatus 36 for adjusting the amount of water vapor exiting the humidifier and thus entering humidor 10 from openings 32. Adjustment apparatus 36, including longitudinally-extending slats 38, is mounted in track elements 40A, 40B at first and second ends of cover 21B over emission chamber 26. Slats 38 extend longitudinally along the length of cover 21B over emission chamber 26 and thereby define a longitudinally-extending opening 39 therebetween. Ends of the slats are integral with transversely-extending rails 41 which, when mounted to cover 21B extend into track elements 40A, 40B of the cover. Adjustment apparatus 36 thus slides in track elements 40A, 40B transversely across the top of emission chamber 26 to a first position where slats 38 at least partially close openings 32 and thereby modify, limit, or reduce the amount of water vapor emitted from the emission chamber. Adjustment apparatus 36 can also slide to a second position where slats 38 substantially overlie bars 30A, 30B, and cover less of openings 32, whereby a maximum rate of emission of water vapor is enabled.

Figure 5A:
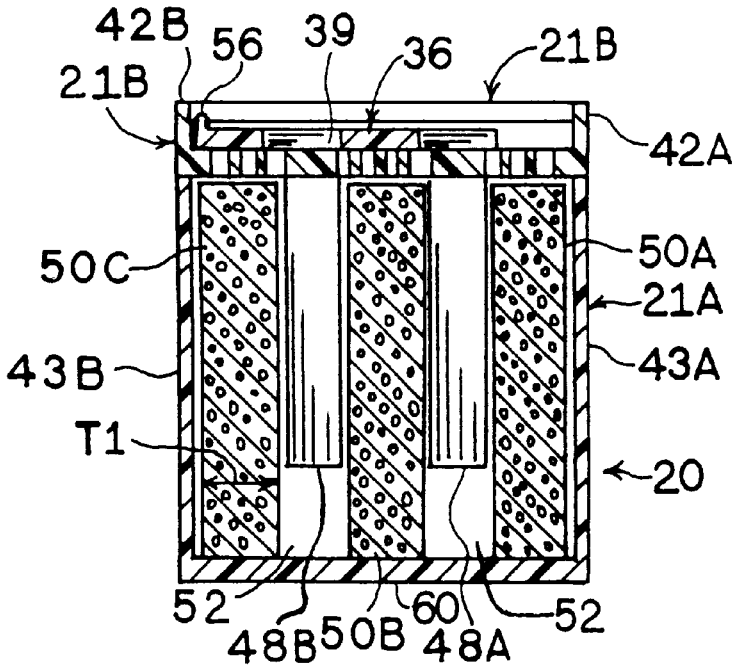
FIG. 5A shows a cross-section view of the embodiment of FIG. 2 including adjustment apparatus in the closed position, taken at line 5—5.
Figure 5B:
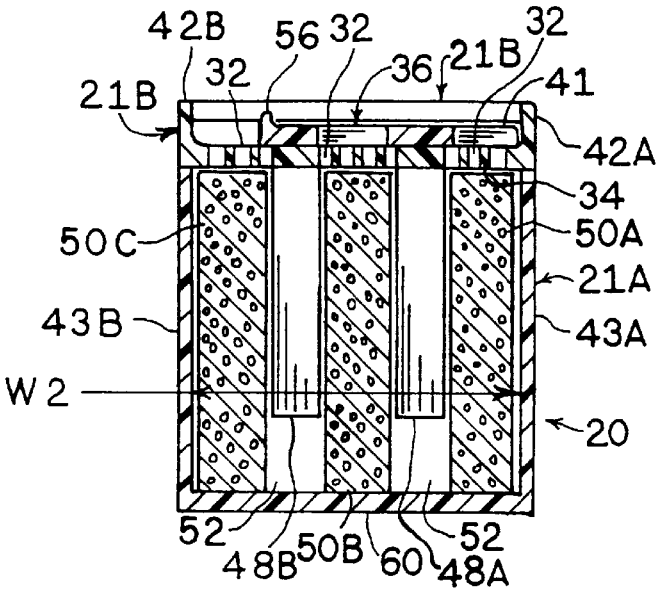
FIG. 5B shows a cross-section view of the embodiment of FIG. 2 including adjustment apparatus in the open position, taken at line 5—5.

Top rims 42A, 42B of receptacle 21A, shown in FIGS. 5A and 5B, extend the entire length of the emission chamber. Rims 42A, 42B comprise the top edges of sidewalls 43A, 43B of humidifier 20. Rims 42A, 42B provide a stop for adjustment apparatus 36 such that the adjustment apparatus remains on cover 21B when the cover is installed on the receptacle. Rims 42A, 42B prevent adjustment apparatus from moving beyond track elements 40A, 40B when cover 21B is installed in receptacle 21A.

Figure 4:
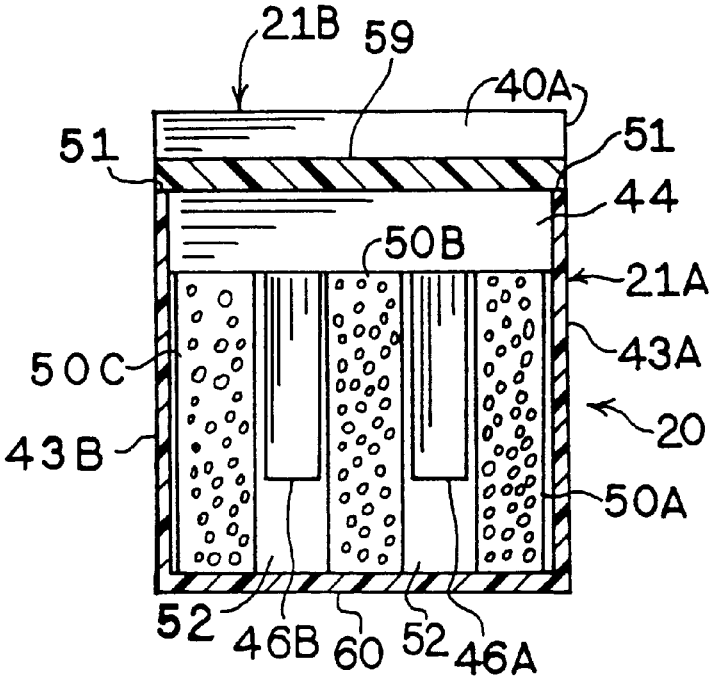
FIG. 4 shows a cross-section view of the embodiment of FIG. 2 taken at line 4—4.

FIG. 4 shows a cross-section view taken at line 4—4 in FIG. 2. Cover 21B includes a downwardly-extending dividing wall 44 where emission chamber 26 and fill chamber 24 meet. In this manner, dividing wall 44 defines fill chamber 24 and emission chamber 26 as separate liquid-receiving entities. A first set of legs 46A, 46B extends downwardly from support bars 30A, 30B, at a location spaced rearwardly of dividing wall 44.

Dividing wall 44 interfaces in surface-to-surface relationship with top portions of the ends of absorbent bodies 50A–50C and thus assists in maintaining absorbent bodies 50A–50C in emission chamber 26. As shown in FIG. 5A, a second set of legs 48A, 48B extends downwardly from support bars 30A, 30B intermediate the lengths of the support bars, thus to assist in maintaining spacing between absorbent bodies 50A–50C and thus, in combination with dividing wall 44, maintaining the absorbent bodies in emission chamber 26. A third set of legs 49A, 49B (FIG. 6) extends similarly downwardly from support bars 30A, 30B at the end of cover 21B remote from fill opening 22. The spacing of absorbent bodies 50A–50C from each other by legs 48A, 48B forms channels 52 between the absorbent bodies and extending along the length of emission chamber 26. Cover 21B is supported from receptacle 21A at top edges 51 at opposing ends of the receptacle.

FIG. 5A shows adjustment apparatus 36 in a closed position such that openings 32 above absorbent bodies 50B, 50C are substantially closed by slats 38. However, opening 32 above absorbent body 50C remain uncovered, allowing moisture-laden air to exit humidifier 20 at a decreased rate.

FIG. 5B shows adjustment apparatus 36 in an open position such that slats 38 are aligned above support bars 30A, 30B so that openings 32 are substantially uncovered. Thus, in the position shown in FIG. 5B, maximum exiting of water vapor through openings 32 occurs. Therefore, by selectively positioning adjustment apparatus 36, the amount of water vapor entering humidor 10 can be adjusted and controlled. Thus the humidity level in humidor 10 is regulated.

FIG. 1 shows housing 21 of humidifier 20 adjacent the right side of humidor 10. Humidor 10 comprises a second receptacle having an inside height "H1", an inside length "L1", and an inside width "W1", together defining a first total contained volume inside the humidor when the lid is closed. Similarly housing 21 of humidifier 20 has inside heights "H2" and "H3" (FIG. 6), an inside length "L2" (FIG. 6), and an inside width "W2" (FIG. 5B), thus defining a second total contained volume inside humidifier 20. The inside height "H3" of the emission chamber must be at least slightly greater than the inside height "H2" of the fill chamber. The greater height ensures that the top of absorbent bodies 50A–50C do not become immersed or covered by water. The tops of absorbent bodies 50A–50C have a greater evaporation rate than a corresponding surface of water. Thus, covering the tops of absorbent bodies 50A–50C would decrease the amount of water evaporating into water vapor. Therefore, the amount of water vapor diffusing outwardly and downwardly from humidifier 20 would be reduced. In conclusion, having height "H3" greater than height "H2" ensures proper operation of the humidifier.

Figure 7:
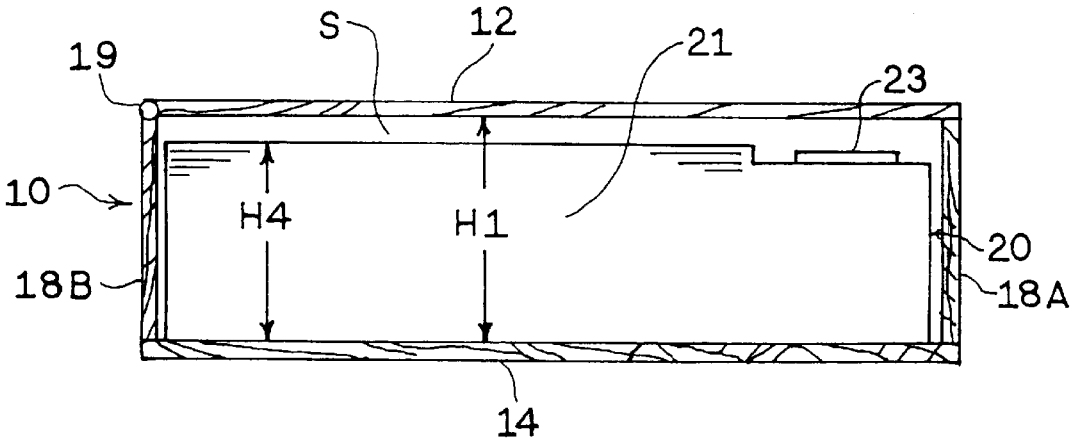
FIG. 7 shows a cross-section view of a humidor including a humidifier located therein.

The total contained volume of humidifier 20 preferably comprises less than 20% of the total contained volume inside humidor 10 when the lid is closed. The outside height "H4" (FIG. 7) of humidifier 20 at emission chamber 26 is less than the inside height "H1" of the humidor receptacle, such that water vapor can readily diffuse out of the humidifier at the top of emission chamber 26, and into and through a space "S" (FIG. 7) between the top of the humidifier and the closed lid of the humidor. The water vapor can then diffuse from space "S" throughout the closed volume of the humidor, including into any product contained therein, thus to benefit the product. Such diffusion is beneficially assisted by the fact that the water vapor is generally heavier than dryer air elsewhere in the humidor, whereby the elevated starting location takes advantage of gravity as the water vapor moves outwardly, and especially downwardly throughout the humidor.

The length of housing 21 of humidifier 20 extends substantially across no more than one of the inside width "W1" and the inside length "L1" of the receptacle of humidor 10. Preferably, and as shown in FIG. 1, length "L2" of housing 21 of humidifier 20 extends across the full width "W1" of humidor 10. Generally, the length of housing 21 substantially equals the length of cigars to be stored in humidor 10.

Housing 21 of humidifier 20 generally has a rectangular shape as illustrated in the drawings. A rectangular shape is preferred. A rectangular shaped housing can contain more liquid than a cylindrical housing where the height and width of the rectangular housing are equivalent to the diameter of the cylindrical housing.

Humidifier 20 is removable from humidor 10 for servicing thereof. For example, closure cap 23 located at the top of fill chamber 24 can be removed, and water added to the fill chamber through fill opening 22 (FIG. 2). While closure cap 23 is illustrated as having a circular shape, other shapes, sizes, and locations for the closure cap are contemplated. Other embodiments of the invention contemplate that humidifier 20 may be an integral part of humidor 10. Such an arrangement, however, prevents use of humidifier 20 with a different humidor, or replacement of the humidifier with a newer humidifier.

Fill chamber 24 and emission chamber 26, in combination, preferably have sufficient total contained volume that humidifier 20 provides desired amounts of water vapor to humidor 10 for a time period of about 3 months to about 6 months without requiring the addition of water to the humidifier.

Figure 6:
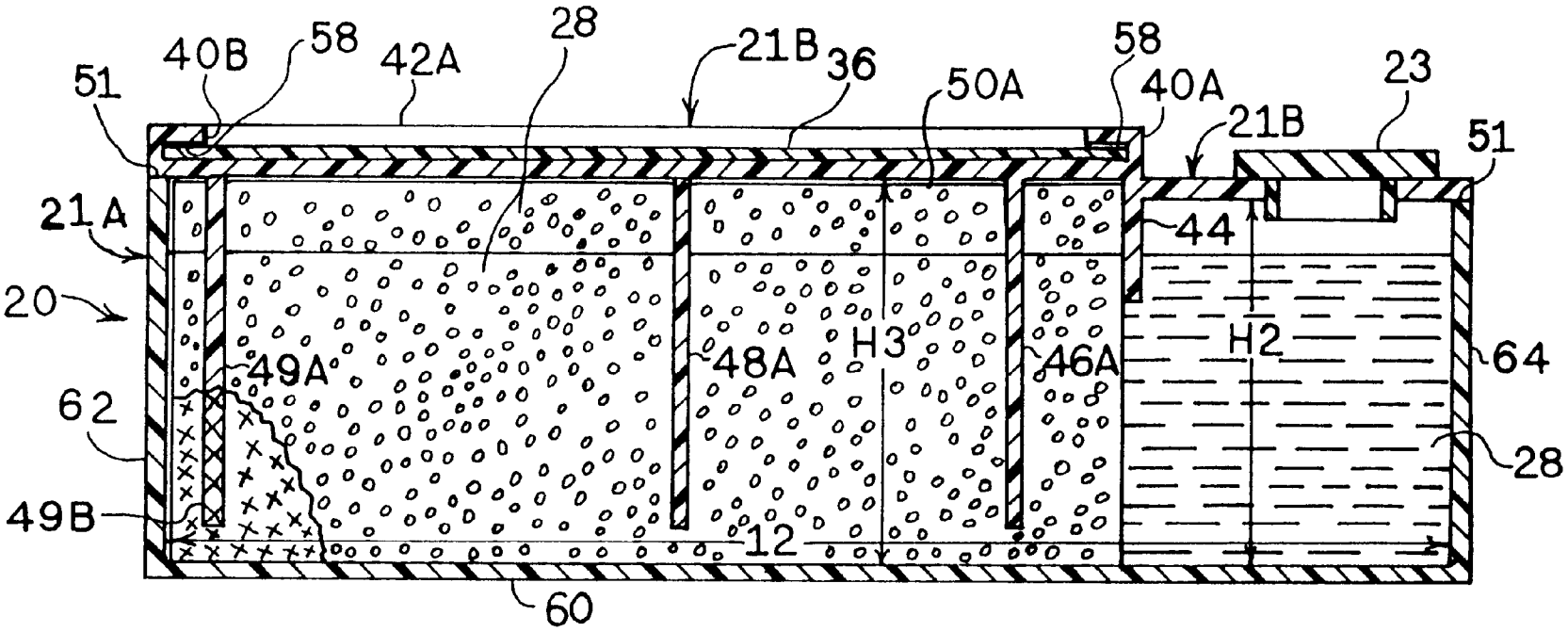
FIG. 6 shows a cross-section view of the embodiment of FIG. 2 including adjustment apparatus, taken at line 6—6.

FIGS. 2 and 6 illustrate the relationship between fill chamber 24 and emission chamber 26. Emission chamber 26 extends along the length of housing 21 of humidifier 20 from track element 40A to track element 40B. Cover 21B comprises two support bars 30A, 30B preferably having widths from about 0.2 inch to about 0.3 inch and extending along the length of the emission chamber between track elements 40A, 40B. Openings 32 are located between and on opposing sides of support bars 30A, 30B, outside the support bars. Anti-splash bars 34 extend along the length of openings 32, and thus substantially along the lengths of emission chamber 26 between track elements 40A, 40B. Anti-splash bars 34 divide the openings into multiple opening segments as shown in FIG. 2. Multiple opening segments permit water vapor to exit emission chamber 26 through cover 21B and to diffuse thence throughout humidor 10.

Anti-splash bars 34 decrease the likelihood and quantity of water that may splash out of emission chamber 26 during movement thereof. Anti-splash bars 34 are optional and thus are not a necessary part of the invention. If utilized, anti-splash bars 34 preferably have a thickness "T" of no more than about 0.1 inch. Anti-splash bars 34 also assist in keeping objects from entering emission chamber 26 through openings 32.

FIG. 3 illustrates adjustment apparatus 36 including slats 38 for covering and thereby adjusting the effective sizes of openings 32 and thus controlling the amount of water vapor reaching space "S" and thus reaching the interior of humidor 10. Adjustment apparatus 36 includes a handle 56 for assisting in sliding movement of the adjustment apparatus to thereby effect at least partial blockage of openings 32. Handle 56 extends upwardly from the right one of slats 38 as seen in FIG. 3, and away from the top of emission chamber 26 for ease in sliding adjustment of adjustment apparatus 36. The rest of adjustment apparatus 36 including slats 38 is substantially flat to permit sliding on the generally flat top of cover 21B over emission chamber 26. In use, end rails 41 of adjustment apparatus 36 slidably fit into slots 58 of track elements 40A, 40B as illustrated in the cross section in FIG. 6. Track elements 40A, 40B allow adjustment apparatus 36 to slide on top of cover 21B, over emission chamber 26 within the confined area defined between upper rims 42A, 42B of side walls 43A, 43B shown in FIGS. 2, 5A, 5B, and 6. Track elements 40A, 40B and rims 42A, 42B confine and retain adjustment apparatus 36 over emission chamber 26. As illustrated in FIG. 6, track element 40B includes slot 58 which extends the entire length of the track element (e.g. along width "W2" of receptacle 21A) to thereby retain a respective end rail 41 of adjustment apparatus 36. The distance between track elements 40A, 40B, including slots 58, is slightly greater than the overall length of adjustment apparatus 36, such that rails 41 fit in slot 58 for sliding motion in a transverse direction across the top of emission chamber 26. Handle 56 permits a user to slide adjustment apparatus 36 along the top of cover 21B to effect slats 38 at least partially covering openings 32 and thereby reducing, limiting, and controlling the amount of water vapor exiting humidifier 20. As needed, handle 56 can be used to move adjustment apparatus 36 such that slats 38 are substantially over openings 32 whereby less water vapor is released from humidifier 20. Similarly, slats 38 may be moved over support bars 30A, 30B whereby emission of water vapor through openings 32 is substantially unimpeded.

While FIG. 2 shows three major openings 32 and FIG. 3 shows two slats 38 for covering the open areas, these numbers of openings and slats are not critical to the invention. For example, more major open areas can be utilized, and adjustment apparatus 36 can have more slats 38 for covering the respective open areas. However, preferably at least opening 32 disperses water vapor from humidifier 10 and throughout humidor 10 even when the adjustment apparatus is fully engaged on cover 21B to cover and thereby substantially close off a maximum fraction of the cover.

All of the elements shown in the top view of FIG. 2, except for closure cap 23 and rims 42A, 42B of side walls 43, preferably comprise a single integral plastic element. Thus, unitary cover 21B includes track elements 40A, 40B, support bars 30A, 30B, and anti-splash bars 34, over emission chamber 26, and a roof 59 over fill chamber 24. Typical plastics for cover 21B include polypropylene, polyethylene, or the like. Other materials, however, can also be utilized to form cover 21B.

Adjustment apparatus 36 preferably is made out of the same or similar plastics as cover 21B.

Receptacle 21A, comprising bottom wall 60, back wall 62, front wall 64, and side walls 43A, 43B preferably also comprises a second unitary element made out of similar plastics as cover 21B. The two unitary plastic elements can be adhesively secured or otherwise attached to one another to form the closed housing 21 of humidifier 20. If needed, the elements can be removably secured to one another to permit opening of housing 21 (e.g. for cleaning, or for replacement of absorbent bodies 50A–50C).

All of the plastic elements forming humidifier 20 preferably have thicknesses between about 0.01 inch and about 0.1 inch. The thicknesses of some elements, such as side walls 43A, 43B, can be less than the thicknesses of other elements.

FIGS. 4 and 6 show dividing wall 44 retaining and confining absorbent bodies 50A–50C within emission chamber 26. Dividing wall 44 extends downwardly from the top of cover 21B and thus defines the division of housing 21 into fill chamber 24 and emission chamber 26. Absorbent bodies 50A–50C are retained behind dividing wall 44 and thus are prevented from entering fill chamber 24. Legs 46A, 46B, spaced rearwardly from dividing wall 44, as illustrated in FIGS. 4 and 6, assist in spacing absorbent bodies 50A–50C from each other and may assist in preventing the absorbent bodies from entering fill chamber 24.

As illustrated in FIG. 5A, at least a second set of legs 48A, 48B may extend downwardly from the top of cover 21B at support bars 30A, 30B, into emission chamber 26. Legs 48A, 48B maintain spacing between absorbent bodies 50A–50C due to their location therebetween, thus assisting in forming channels 52. A third set of legs 49A, 49B (FIG. 6) is present in emission chamber 26 to further assist in spacing absorbent bodies 50A–50C from one another, to form channels 52. Channels 52 between absorbent bodies 50A–50C preferably extend the entire length of emission chamber 26. Legs 46A, 46B, 48A, 48B, 49A, 49B are joined to support bars 30A, 30B.

Dividing wall 44, and the leg sets as described above, preferably are integral with unitary cover 21B.

Correspondingly, dividing wall 44 and legs, preferably are made from similar plastic materials as support bars 30A, 30B, and track elements 40A, 40B.

While two channels 52, corresponding three leg sets, and three absorbent bodies 50A–50C, are shown in FIGS. 4–6, the number of channels 52 and thus corresponding number of legs in each set, and the number of absorbent bodies, can be varied. Preferably, however, at least two channels, as shown in FIGS. 4, 5A, and 5B, are present. Two channels permit water 28 to flow into and fill emission chamber 26 directly from fill chamber 24 along the length of absorbent bodies 50A–50C and thus alongside surface areas of the absorbent bodies to permit relatively fast absorption of water therein. In this manner, fill chamber 24 can be filled to a high level in a matter of seconds without having to wait for the water to be absorbed by a single absorbent body, or to wait for the water to diffuse through the absorbent body along the length of the emission channels. By providing for channels 52, and relatively thin thicknesses of the absorbent bodies along channels, the transverse thickness "T1" (FIG. 5A) in general represent the maximum length diffusion path for water diffusing into the absorbent bodies. Thus, channels 52 permit absorption of water along the entire lengths of absorbent bodies 50A–50C whereby channels 52 favorably affect the rate at which water is absorbed into absorbent bodies 50A–50C.

As shown in FIG. 4, the bottom of fill chamber 24 is directly connected across its entire width to emission chamber 26 is integral with, and on a common plane with, the bottom of emission chamber 26. Thus water poured into fill chamber 24 quickly flows into emission chamber 26 and wicks transversely and upwardly into absorbent bodies 50A–50C.

As shown in FIG. 5A, absorbent bodies 50A–50C preferably are located directly below openings 32. Thus after water wicks to the top surfaces of absorbent bodies 50A–50C, and evaporates, the water vapor can diffuse directly out of humidifier 20 through openings 32. The water evaporating at the top of absorbent body 50A need only move a small distance to be dispensed from humidifier 20 through the respective opening 32, and into space "S". This is because the top surfaces of absorbent bodies 50A–50C effectively abut the anti-splash bars 34. Therefore, having the tops of absorbent bodies 50A–50C substantially adjacent openings 32 increases the rate at which water vapor diffuses outwardly from the openings. The water vapor does not have to move upwardly a significant distance to egress from humidifier 20. Since water vapor is heavier than dry air having a similar temperature, once out of the humidifier and in space "S", the water vapor tends to move outwardly and downwardly, thus distributing the water vapor throughout humidor 10. Therefore, having water vapor exit the humidifier at the top of the humidifier improves the overall distribution of humidity in the humidor.

As an alternative to the illustration in FIG. 1, humidifier 20 can be placed in the center of humidor 10, intermediate length "L1," thus to generally divide the total overall inside volume of the humidor into two product-receiving sections, separated by the humidifier. In such embodiment, the water vapor moves from space "S" over the humidifier in opposing directions toward walls 16A, 16B and the two product-receiving sections.

Water vapor evaporating from the sides of absorbent bodies 50A–50C and any water standing at the bottom of emission chamber 26 between the absorbent bodies, of course, can also diffuse from emission chamber 26 through openings 32. However, the alignment of the tops of absorbent bodies 50A–50C directly under openings 32 increases the amount of water vapor diffusing out of humidifier 20 by evaporation. Likewise alignment of support bars 30A, 30B substantially directly over channels 52 impedes diffusion, out of emission chamber 26, of water vapor in the air over the channels.

Absorbent bodies 50A–50C preferably comprise foam material, such as a phenol-based foam material, for example phenol formaldehyde foam. A preferred foam material is FOLIAGE FRESH™ by FloraCraft of Ludington, Mich. FOLIAGE FRESH™ is a phenolic foam. Other cellular foam materials can also be utilized. For example, a urea-based foam material can be utilized. The foam material absorbs water therein and moves the water to the top surface of the foam material by a wicking effect. While foam materials are preferred, other absorbent bodies having similar absorbent and wicking properties can also be utilized.

Wicking effect, can be considered the movement of water in the X, Y, and Z directions of a three dimensional absorbent body 50. In the embodiments described herein, where only a small amount of water is present in the humidifier, wicking generally begins at the bottom outside edges of absorbent bodies 50A–50C and water moves generally upwardly in the X, Y, and Z directions. Thus wicking can occur in a direction in opposition to the direction of the force of gravity. Therefore wicking can lead to complete saturation of an entire absorbent body. In this manner, wicking can cause water to move to all of the outside surfaces of absorbent body 50, thus to evaporate.

Absorbent bodies 50A–50C preferably comprise separate elements separated by channels 52, the absorbent bodies having rectangular shapes. Channels 52 extend the entire lengths and heights of absorbent bodies 50A–50C in such an embodiment. In the embodiment of FIGS. 4, 5A and 5B, channels 52 preferably have a width from about 0.1 inch to about 0.4 inch. In the embodiment of FIGS. 4, 5A, and 5B, each absorbent body preferably has a length of between about 4 inches and about 6 inches, a height of between about 1.5 inches and about 2 inches, and a thickness of between about 0.3 and about 0.6 inch. The height of each absorbent body 50 preferably approximates the height of emission chamber 26. Thus, as described earlier, there is effectively no spacing between absorbent body 50 and antisplash bars 34 of opening 32. In fact, in some embodiments, absorbent body 50 is in direct physical contact with antisplash bars 34. The length of each absorbent body 50 preferably corresponds approximately to the length of emission chamber 26.

The surface area of the top surfaces of absorbent bodies 50A–50C, in combination, preferably is no greater than the surface area of the bottoms of the absorbent bodies, in combination. Having such surface areas allows water to properly wick throughout the entire volume of absorbent bodies 50A–50C. This is so because there is increased resistance to generally upward wicking where an upper region of the absorbent body has a greater cross-section than a respective lower region through which water would have to wick in order to reach the upper region. Therefore, to obtain saturation in an efficient manner, the lower region must have at least about the same surface area or, as appropriate, cross-section as the upper region. Thus, for each individual absorbent body 50, where the bodies are defined as separate elements, the top surface area of the respective absorbent body 50 should be no greater than the bottom surface area of the respective absorbent body 50, or any cross-section of the absorbent body between the top and bottom surfaces.

In preferred embodiments, humidifier 20 is devoid of absorbent material outside the combination of fill chamber 24 and emission chamber 26. Absorbent material preferably is only contained in emission chamber 26, and in fill chamber 24.

Humidifier 20, of course, defines receptacle 21A for containing water. Receptacle 21A of humidifier 20 has total overall internal volume as discussed above. Housing 21 of humidifier 20 preferably has an overall length of about 6.5 inches. In this embodiment, the length of housing 21 generally equals the length of commonly available cigars to be stored in humidor 10, but other embodiments do not necessarily do so. Housing 21 preferably has a width of about two inches and a height of between about 2 inches and about 3 inches depending on the size of the humidor 10 the housing is being designed for. The height value is designed to be close to the inside height of the humidor 10 that the housing 21 is designed for. Therefore, much greater latitude is present in the width value for the humidifier than for the height.

In other embodiments humidifier 20 is raised or secured to a side wall of humidor 10 so that the top of the humidifier is above any cigars contained in the humidifier. Having the humidifier openings 32 above the highest cigar ensures proper humidity to store the cigars. Humidifier 20 can be raised by any item, such as a wood block, placed below the humidifier. Hook and loop fasteners, such as VELCRO™, can be secured to the side wall of humidor 10 and humidifier 20 to permit securement of the humidifier at a proper location adjacent the lid of the humidor.

The volume of absorbent bodies 50A–50C in emission chamber 26, in combination, comprises from about 35% to about 70%, of the total overall internal volume of the receptacle of housing 21 of humidifier 20. In another embodiment, the volume of absorbent bodies 50A–50C, in combination, comprises from about 40% to about 60% of the internal volume of the receptacle. The volume of absorbent bodies 50A–50C, in combination, most preferably about 40% to about 50%, of the internal volume of the receptacle.

Further, emission chamber 26 generally defines from about 40% to about 90% of the internal volume of the receptacle of humidifier 20. Emission chamber 26 preferably defines from about 50% to about 80%, and most preferably from about 60% to about 75% of the internal volume of the entire receptacle.

Fill chamber 24 permits quick and safe filling of humidifier 20 with water. The presence of fill chamber 24, separate from emission chamber 26, prevents poured water from damaging somewhat fragile absorbent bodies 50A–50C.

While humidifier 20 is shown in FIG. 1 with a humidor 10 having a lid, the humidifier is useful with all varieties of humidors. For example, humidifier 20 can be utilized for a drawer type humidor or a humidor having a swinging door at the front thereof.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A humidor, comprising:

(a) a product-receiving receptacle receiving and storing tobacco products in a suitable humidity environment, said receptacle having a top and a bottom, and a lid associated with the top; and (b) a humidifier removably received in said product-receiving receptacle, said humidifier comprising, (i) an emission chamber having a top and including at least one absorbent body therein, and (ii) a fill chamber devoid of absorbent bodies and receiving water into said humidifier, said fill chamber having a fill opening accessible and operable for filling water thereinto while said humidifier is disposed for use in said product-receiving receptacle, said emission chamber receiving water flowing laterally by gravity from said fill chamber, water evaporating from said absorbent body, and forming water vapor, diffusing out of said humidifier through at least one opening in the top of said emission chamber, said at least one opening being located near the top of said receptacle, such that the water vapor moves outwardly and downwardly therefrom toward the bottom of said receptacle.

2. A humidor as in claim 1, said product-receiving receptacle being rectangularly-shaped and having an inside height, inside length, and inside width, said humidifier having a length, a width, and a height, the length of said humidifier extending substantially across the entirety of no more than one of the inside width and the inside length of said receptacle.

3. A humidor as in claim 2, the height of said humidifier being less than the inside height of said receptacle, such that water vapor can readily diffuse from the top of said humidifier and into and through a space between the top of said humidifier and said lid of said humidor, thus to move thence throughout said humidor.

4. A humidor as in claim 1, said fill chamber and said emission chamber having sufficient volume that said humidifier provides desired amounts of water vapor to said humidor for about 3 to about 6 months without requiring the addition of water to said humidifier.

5. A humidor as in claim 1, said emission chamber receiving water from said fill chamber, said at least one absorbent body receiving water and transporting the water therein by wicking, including wicking water to a top surface thereof.

6. A humidor as in claim 1, said at least one absorbent body comprising a phenol-based foam material.

7. A humidor as in claim 1, said fill chamber and said emission chamber of said humidifier comprising receptacle walls thereof made of plastic, said receptacle walls of said fill chamber, and bottom and side ones of said receptacle walls of said emission chamber, comprising an integral plastic unit.

8. A humidor as in claim 1, said product-receiving receptacle having an inside height, an inside length, and an inside width, together defining a total contained volume inside said humidor when said lid is closed, said humidifier comprising less than 20% of the total volume inside said humidor.

9. A humidor as in claim 1, said humidifier including a dividing wall partially separating said fill chamber and said emission chamber, said dividing wall assisting in retaining said at least one absorbent body in said emission chamber.

10. A humidor as in claim 1, including adjustment apparatus adjusting the amount of water vapor entering said receptacle through said at least one opening, such that said humidifier modifies the humidity inside said receptacle.

11. A humidor for storing tobacco products in a suitable humidity environment, said humidor having a top and a bottom, and a lid associated with the top, and including a humidifier for controlling humidity in said humidor, said humidifier comprising:

(a) a fill chamber for receiving water into said humidifier;

(b) an emission chamber for receiving water from said fill chamber, said emission chamber having a top and including at least one absorbent body therein, water vapor evaporating from said absorbent body when said emission chamber contains water, and diffusing out of said humidifier through at least one opening in the top of said emission chamber, said at least one opening being located near said lid of said humidor, such that said water vapor moves downwardly therefrom toward the bottom of said humidor; and (c) adjustment apparatus adjusting the amount of water vapor entering said humidor through said at least one opening, such that said humidifier modifies the humidity of said humidor, said adjustment apparatus comprising slats mounted in track elements located at first and second ends at the top of said emission chamber, said slats extending along the length of the top of said emission chamber, said slats being moveable transversely across the top of said emission chamber to at least partially close said at least one opening and thereby to modify the amount of water vapor emitted from said emission chamber.

12. A humidor for storing tobacco products in a suitable humidity environment, said humidor having a top and a bottom, and a lid associated with the top, and including a humidifier for controlling humidity in said humidor, said humidifier comprising:

(a) a fill chamber for receiving water into said humidifier;

(b) an emission chamber for receiving water from said fill chamber, said emission chamber having a top and including at least one absorbent body therein, water vapor evaporating from said absorbent body when said emission chamber contains water, and diffusing out of said humidifier through at least one opening in the top of said emission chamber, said at least one opening being located near said lid of said humidor, such that said water vapor moves downwardly therefrom toward the bottom of said humidor; and (c) adjustment apparatus adjusting the amount of water vapor entering said humidor through said at least one opening, such that said humidifier modifies the humidity of said humidor, said at least one absorbent body comprising a plurality of absorbent bodies, channels separating said absorbent bodies, said channels extending the entire length and height of said absorbent bodies so to define separate ones of said plurality of absorbent bodies.

13. A humidor as in claim 12, each said separate absorbent body having a length, a width, and a height, the heights of said absorbent bodies approximating the height of said emission chamber.

14. A humidor as in claim 12, a collective top surface area at the combination of the respective tops of the respective said absorbent bodies being no greater than the collective bottom surface area at the combination of the respective bottoms of the respective said absorbent bodies.

15. A humidor as in claim 12, said absorbent bodies having substantially rectangular shapes.

16. A humidor as in claim 12, said at least one opening in the top of said emission chamber comprising one of multiple openings extending along substantially the entirety of the length of the top of said emission chamber, said multiple openings being disposed between bars which extend along the length of the top of said emission chamber.

17. A humidor as in claim 16, respective said bars being aligned substantially directly over respective said channels thus to impede diffusion of water vapor from above said channels and out of said emission chamber.

18. A humidor for storing tobacco product in a suitable-humidity environment, said humidor having a top and a bottom, a lid associated with the top, and including a humidifier for controlling humidity in said humidor, said humidifier comprising:

(a) a fill chamber receiving water into said humidifier; and (b) an emission chamber containing at least first and second absorbent bodies separated by at least one channel, the at least one channel being defined between and extending along respective lengths of said absorbent bodies along a length of said emission chamber, water flowing from said fill chamber directly into said at least one channel in said emission chamber, said at least one channel extending alongside surface areas of said absorbent bodies thereby to affect the rate at which water is absorbed into said absorbent bodies, water evaporating from said absorbent bodies and forming water vapor, said water vapor diffusing out of said humidifier through at least one opening in said humidifier.

19. A humidor as in claim 18, said absorbent bodies absorbing water until said absorbent bodies are saturated, such that water is present at the top surfaces of said absorbent bodies.

20. A humidor as in claim 18, said at least one opening being located at the top of said emission chamber.

21. A humidor as in claim 18, said humidifier further including adjustment apparatus adjusting the amount of water vapor entering said humidor through said at least one opening, such that said humidifier modifies the humidity of said humidor.

22. A humidor as in claim 21, said adjustment apparatus comprising slats mounted in track elements located at first and second ends at the top of said emission chamber, said slats extending along the length of the top of said emission chamber, said slats being moveable transversely across the top of said emission chamber to at least partially close said at least one opening and thereby to modify the amount of water vapor emitted from said emission chamber.

23. A humidor as in claim 18, said humidor comprising a rectangularly-shaped receptacle having an inside height, an inside a length, and an inside width, said humidifier having a length, width, and a height, the length of said humidifier extending substantially across the entirety of only one of the inside width and the inside length of said receptacle.

24. A humidor as in claim 23, the height of said humidifier being less than the inside height of said receptacle, such that water vapor can readily diffuse from the top of said humidifier and into and through a space between the top of said humidifier and said lid of said humidor, thus to move thence throughout said humidor.

25. A humidor as in claim 18, said at least one channel comprising a first channel between said first and second absorbent bodies, and a second channel between said second absorbent body and a third absorbent body, each said channel extending the entire height of the respective said absorbent body such that said absorbent bodies comprise separate bodies, each said separate absorbent body having a length, a width, and a height.

26. A humidor as in claim 25, said emission chamber having an inside height, the heights of said absorbent bodies approximating the inside height of said emission chamber.

27. A humidor as in claim 25, a collective top surface area at the combination of the respective tops of the respective said absorbent bodies being no greater than the collective bottom surface area at the combination of the respective bottoms of the respective said absorbent bodies.

28. A humidor as in claim 18, said absorbent bodies comprising urea-based foam material.

29. A humidor as in claim 18, said emission chamber having a top, said at least one opening being disposed in the top of said emission chamber and comprising one of multiple openings extending along substantially the entirety of the length of the top of said emission chamber, said multiple openings being disposed between bars which extend along the length of the top of said emission chamber.

30. A humidor as in claim 29, said at least one channel comprising multiple channels, respective said bars being aligned substantially directly over respective said channels thus to impede diffusion of water vapor from above said channels and out of said emission chamber.

31. A humidor as in claim 18, said humidifier being free from absorbent material outside the combination of said emission chamber and said fill chamber.

32. A humidifier for use in a humidor, comprising a housing defining a receptacle for receiving water thereinto, and an emission chamber having absorbent bodies therein, said absorbent bodies being separated by at least one channel, water vapor evaporating from said absorbent bodies when said emission chamber contains water, diffusing out of said humidifier through at least one opening and thence outwardly from said humidifier to thereby provide moisture-laden air to the interior of a humidor, said humidifier being free from absorbent material outside said receptacle, said housing including a fill chamber for introducing water into said humidifier, said fill chamber opening to said emission chamber such that water received into said fill chamber readily flows into said emission chamber and contacts said absorbent bodies for absorption thereinto, said housing including a separate top element disposed at the top of said housing, said top element closing said housing, said separate top element including said at least one opening for emitting water vapor from said emission chamber, and a fill opening proximate the top of said fill chamber.

33. A humidifier as in claim 32, said separate top element including track elements located at first and second ends of said emission chamber, said track elements receiving slats, said slats extending along the length of the top of said emission chamber, said slats being moveable transversely across the width of the top of said separate top element thereby to at least partially close said at least one opening and thereby to adjust the amount of water vapor diffusing out of said emission chamber.

34. A humidifier as in claim 32, said separate top element including spaced positioning legs extending downwardly toward the bottom of said housing and inside said humidifier.

35. A humidifier as in claim 32, said separate top element including a dividing wall extending downward toward the bottom of said housing, said dividing wall partially dividing said housing to thereby separate said fill chamber and said emission chamber, said dividing wall retaining said absorbent bodies in said emission chamber.

36. A humidifier as in claim 32, said at least one opening being located at the top of said emission chamber.

37. A humidifier as in claim 32, said at least one channel comprising a first channel, and a second channel between respective ones of said absorbent bodies, said channels separating said absorbent bodies, said channels extending the entire height of said absorbent bodies such that said absorbent bodies comprise separate elements.

38. A humidifier as in claim 37, said separate absorbent bodies having lengths, widths, and heights, the heights of said absorbent bodies approximating the height of said emission chamber.

39. A humidifier as in claim 32, said absorbent bodies having a collective top surface area at the combination of the respective tops of the respective said absorbent bodies being no greater than the collective bottom surface area at the combination of the bottoms of the respective said absorbent bodies.

40. A humidor for storing tobacco products including said humidifier of claim 32 for controlling humidity therein.

41. A humidifier as in claim 32, said receptacle defining an internal void volume, the volume of said absorbent bodies in combination comprising from about 35% to about 70% of the internal void volume of said receptacle.

42. A humidifier as in claim 41, said absorbent bodies comprising phenol-based foam material.

43. A humidifier as in claim 32, said receptacle defining an internal void volume, said emission chamber defining from about 40% to about 90% of the internal void volume of said receptacle.

44. A humidor comprising said humidor and a humidifier for controlling humidity therein, said humidor having an inside height, an inside length, and an inside width, said humidifier having an outside length, an outside width, and an outside height, said humidifier being received inside said humidor, the outside length of said humidifier extending across substantially the entirety of the inside width of said humidor, said humidifier comprising a housing defining a receptacle for receiving water thereinto, and an emission chamber having absorbent bodies therein, said absorbent bodies being separated by at least one channel, water evaporating from said absorbent bodies into water vapor, said water vapor diffusing out of said humidifier through at least one opening and thence outwardly from said humidifier to thereby provide moisture-laden air to the interior of a humidor, said humidifier being free from absorbent material outside said receptacle.

45. A humidor as in claim 44, said humidor having a lid on the top thereof, the outside height of said humidifier at the at least one opening being less than the inside height of said humidor with the lid in a closed position, such that water vapor emitted from the at least one opening at a top of said humidifier has sufficient space between the top of said humidifier and said lid of said humidor to readily move outwardly from said humidifier and about in said humidor.

* * * * *